US005282651A

United States Patent [19]

Alonso

[11] Patent Number: 5,282,651

[45] Date of Patent: Feb. 1, 1994

[54] TRADING CARDS AND METHOD OF CONCEALING AND REVEALING INFORMATION THEREON

[76] Inventor: Frank Alonso, P.O. Box 3099, Pacoima, Calif. 91333

[21] Appl. No.: 686,240

[22] Filed: Apr. 15, 1991

[51] Int. Cl.[5] ..... B42D 15/00

[52] U.S. Cl. ..... 283/117; 40/427; 40/446; 283/72; 283/95; 283/97; 283/901; 434/365

[58] Field of Search ..... 40/427, 446; 283/82, 283/95, 81, 901, 97, 117, 72, 85; 434/365, 403, 404, 405

[56] References Cited

U.S. PATENT DOCUMENTS

| | | | |
|---|---|---|---|
| 736,035 | 8/1903 | Stevenson | 283/901 X |
| 3,268,238 | 8/1966 | Finkel | 40/427 X |
| 4,163,570 | 8/1979 | Greenaway | 283/95 X |
| 4,725,462 | 2/1988 | Kimura | 283/97 X |
| 4,973,087 | 11/1990 | Balogh | 283/62 |
| 5,083,815 | 1/1992 | Scrymgeour et al. | 283/72 |

FOREIGN PATENT DOCUMENTS

| | | | |
|---|---|---|---|
| 2310457 | 9/1978 | Fed. Rep. of Germany | 40/446 |

*Primary Examiner*—Paul A. Bell
*Attorney, Agent, or Firm*—Louis J. Bachand

[57] ABSTRACT

Trading cards are made interactive with the user by concealing under a coating the secondary indicia portion of an image comprising both primary and secondary indicia, and selectively altering the coating to reveal the secondary indicia in the presence of the primary indicia to complete the image. A thermochromic coating material responsive to temperature change from ambient temperature, as by rubbing the coating with the fingers, enables the local exposure of the secondary indicia.

5 Claims, 2 Drawing Sheets

TRADING CARDS AND METHOD OF CONCEALING AND REVEALING INFORMATION THEREON

FIELD OF THE INVENTION

This invention relates to trading cards and like cards displaying informational images, and more particularly to such cards which are interactive with the user. Further, the invention has to do with cards and methods by which a portion of the card information is selectively concealed, to be revealed in response to the actions of the user, to amplify card information, to complete a picture, or more generally to make coherent an image comprised of primary and secondary indicia, the secondary indicia having been locally concealed under an coating responsive to actions taken by the user.

BACKGROUND OF THE INVENTION

Trading cards are printed with pictorial, graphic and text information relating to a subject of general or secular public interest. For example, baseball trading cards typically will have the picture of a ballplayer and his lifetime statistics. This combination of informational images is static. The primary indicium of the ballplayer picture and the secondary indicium of statistical text are unchanging.

SUMMARY OF THE INVENTION

There exists a need for trading cards which are interactive with the user, which reveal other and different information responsive to actions taken by the user. Such cards will change the visualized primary or secondary indicia depending on the actions of the user. The formerly known static trading card thus becomes a game and more than mere collected information.

It is an object, therefore, of the present invention to provide a trading card in which the image can be varied by interaction with the user. It is another object to provide a trading card in which different indicia are printed on the card, and certain of the indicia are selectively displayed responsive to a change in temperature from ambient, and not displayed when the temperature reverts. Still another object is to have a color, or transparency or opacity, change in a coating over a portion of a trading card to change the image on the cards by changing the relationship of the primary and secondary printing indicia on the card as a function of the color or transparency change.

These and other objects of the invention to become apparent hereinafter are realized in accordance with the invention in a trading card having a variable printed image comprising subject-related primary and secondary indicia on the card surface, and means to make the secondary indicia non-visible at ambient temperatures to have the card display a first image and to make the secondary indicia visible at other than ambient temperatures to have the card display a second image, the means comprising on the trading card locally secondary indicia comprised of a thermochromic composition in a state to make said secondary indicia non-visible, the thermochromic composition being responsive to temperature change therein from ambient sufficient for the secondary indicia to become visible, whereby effecting the temperature change in the coating varies the card image.

In particular embodiments, the change in the coating, e.g. in color to form the secondary indicia, or in relative opacity or transparency to reveal the secondary indicia is reversible with reversion of temperature to ambient. Typically, the coating is temperature changeable from ambient by rubbing with the fingers, the card is made of cellulosic or plastic material, and the coating comprises a plastic matrix with thermochromic inks distributed therein.

In another embodiment, the invention comprises a trading card having a printed coherent image comprising subject-interrelated primary and secondary indicia printed on the card surface, and means to make the secondary indicia non-visible at ambient temperatures and thus the image incoherent and to make the secondary indicia visible at other than ambient temperatures and thus the image coherent, the means comprising on the trading card locally over the secondary indicia a covering of a thermochromic coating normally opaque to the human eye to make the secondary indicia non-visible, the thermochromic coating being responsive to temperature change therein from ambient to have reduced opacity to the human eye sufficient for the secondary indicia to become visible, whereby effecting the temperature change in the coating makes the card image coherent.

In this as in certain other embodiments, the coherent image primary indicia may comprise the printing ink depiction of a human speaker, and the secondary indicia the printing ink depiction of words of the speaker; or, the coherent image primary indicia may comprise the printing ink depiction of a device in a first state, e.g. inactive, and the secondary indicia comprises the printing ink depiction of the device in a second state, e.g. active; or, the secondary image may be an opaque or simply different color superimposed on the primary indicia and changeable to colorless upon an elevation in temperature to permit the primary indicia color to show; or, the secondary indicia may be a clear coating changeable to a color to add informational images to the card.

In another aspect, the invention comprises a printed card selectively displaying a coherent image comprised of primary and secondary indicia, the card comprising a sheet material having at least one image-bearing surface, a printed image of the primary and secondary indicia on the image-bearing surface, a coating locally disposed over the secondary indicia portion of the printed image, whereby the secondary indicia are not normally visible, a protective covering over the image-bearing surface including the locally disposed coating thereon, the coating being responsive to a temperature change from ambient therein to make the secondary indicia visible and display the coherent image.

In this and like embodiments, the change in the coating is reversible with reversion of its temperature to ambient, coating is temperature changeable from ambient by rubbing with the fingers, the card is made of cellulosic or plastic material, the coating comprises a plastic matrix with thermochromic inks distributed therein, the coherent image primary indicia comprises e.g. the printing ink depiction of a human speaker, and the secondary indicia comprises the printing ink depiction of words of the speaker, or, as a further example, the coherent image primary indicia comprises the printing ink depiction of a device in a first state, and the secondary indicia comprises the printing ink depiction of the device in a second state.

In such and like embodiments, the device first and second states are typically different color states.

The invention further contemplates methods of play and using cards, including the method of selectively revealing a printed coherent informational image comprised of primary and secondary indicia, the secondary indicia being locally covered with a coating, including selecting a coating material having a thermochromic response to temperature change to be a different color, including transparent, at a second, non-ambient temperature than at ambient temperature, and altering the temperature of the coating from ambient to expose the secondary indicia in the presence of the primary indicia to reveal the coherent image.

Also provided is the method of selectively modifying a trading card image having subject-related primary and normally undisplayed secondary indicia, including defining the secondary indicia with thermochromic ink, and locally heating the ink to display the secondary indicia and correspondingly modify the trading card image.

THE DRAWINGS

The invention will be further described in conjunction with the attached drawings in which.

PREFERRED MODES

The term indicium and indicia herein refer to symbols and markings with are cognizable by the human eye, and which together define an image, either pictorial, graphic or text. Primary indicia are those indicia which are first visible in viewing a card; secondary indicia are those which are visible only after a change in the thermochromic coating. The term thermochromic herein refers to the property of color change with heat. Thermochromic inks are compositions capable of color change with heat increases within 50 Degrees Fahrenheit of room temperature, and which can be impressed onto cards by any of various deposition techniques which leave particular patterns, all of which techniques herein are referred to as printing. The term trading card refers to a form of sheet material card on which images are printed for the entertainment, investment or education of the user.

Figure 1:
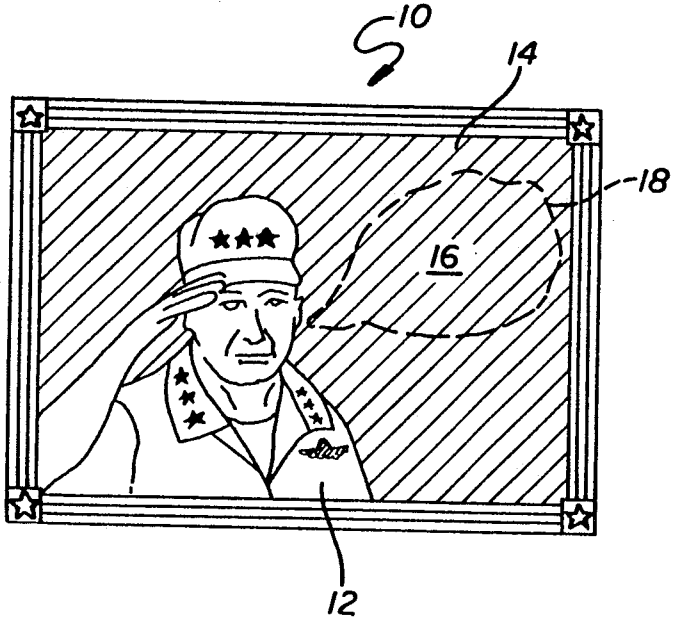
FIG. 1 is an elevational view of a trading card according to the invention with only primary indicia being visible.

With reference to the drawings, in FIG. 1 a trading card 10 is shown, depicting a saluting soldier 12 . The rest of the card face 14 is a non specific image, as shown, or a specific image, not shown, such as buildings, sky or other soldiers. The depiction of the soldier 12 and any other image on card face 14 is printed onto the card 10 with conventional inks, and comprises the primary indicia portion of the card 10.

Although not visible in FIG. 1, secondary indicia are present, pre-printed on the card 10 in the area indicated by the numeral 16. These secondary indicia are not visible by virtue of the use of a coating 18 [FIG. 3] over the secondary indicia area 16 which blocks viewing of the indicia unless the coating 18 goes to a transparent or translucent condition. The secondary indicia can also be hidden in the thermochromic composition itself, as by printing text in the area 16 using thermochromic ink which is transparent or at most translucent until heated, as will be explained hereinafter. In this embodiment, the coating 18 may be dispensed with unless other subject matter is sought to be selectively concealed thereunder. In another variation, the color of the provided image can be varied by superimposing a color change ink as the secondary indicia over the printed primary indicia color, e.g. the soldier can appear to change uniform by a color change in the printed image of his clothing. Or the overprinting can be done in reverse, by having the secondary indicia embodied in the underprinted ink, which is normally transparent, and changes color upon heating to be revealed in addition to or through the overprinted ink, which ink itself can be thermochromic and responsive at a different temperature.

In this invention, the primary and secondary indicia are subject-related, that is they have meaning together, as a speaker and his spoken word, a gun and the muzzle flash, a car color from one color to another within the same car outline, career statistics and a ballplayer, or in general any rendering of subject capable of being broken down into one meaningful image and a second, separate image. One is concealed by normally transparent thermochromic composition or coated with a normally opaque or otherwise concealing layer of thermochromic composition. Mere color change for color change sake achieved with thermochromic compositions, without having the primary and secondary indicia mutually related, is not included in the invention.

The thermochromic compositions are any of the materials commercially available which are responsive to heat to change color, including transparent or translucent to opaque. This type of material is available as Chromic UV Screen Ink from Matsui Shikiso Chemical Co., Ltd., Kyoto, Japan under the trade name Photopia. The Company describes these inks as compositions of micro-capsules of the ink dispersed in acrylic ester oligomer resin, in proportions of 25% to 75%, respectively. Other compositions with the property of color change sufficient to provide the effects described herein can be used, with or without extenders of a polymeric nature.

Figure 2:
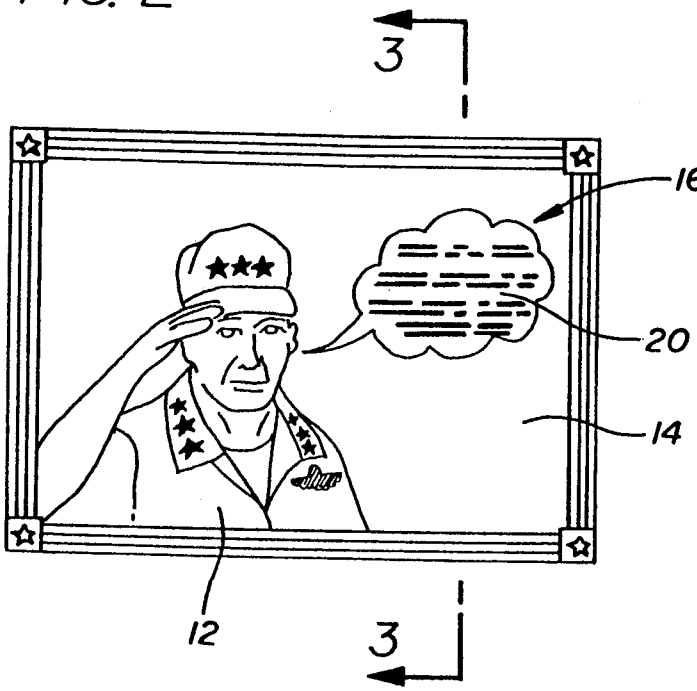
FIG. 2 is a view like FIG. 1 of a trading card, after a thermal change in the coating thereof, showing both primary and secondary indicia as visible.

With reference again to the drawings, in FIG. 2, the secondary indicia area 16 has a localized coating 18 of thermochromic composition. Heating the area 16 slightly, just rubbing between the thumb and index finger will do, causes the coating 18 to change color to transparency. The secondary indicia 20, here illustratively text of the words spoken by the soldier 12, become revealed, but the secondary indicia are only visible while the coating 18 remains heated above ambient.

Figure 3:
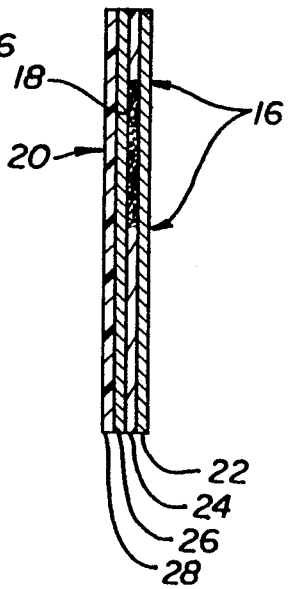
FIG. 3 is view in section taken on line 3—3 in FIG. 2.

In FIG. 3, the laminate nature of the card 10 is shown. The card 10 material itself, which can be paper, cellulosic or plastic, forms layer 22, the primary and secondary printing is shown as layer 24, the coating 18 superimposed locally, in area 16, over the text portion, or secondary indicia 20, and forms the next layer 26 and finally the whole face 14 of the card is covered with a protective plastic film layer 28 against soiling and scratching.

Figure 6:
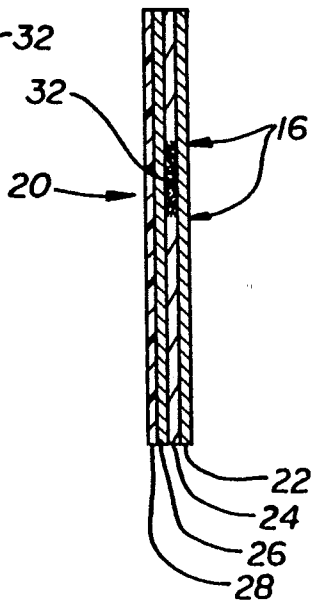
Figure 5:
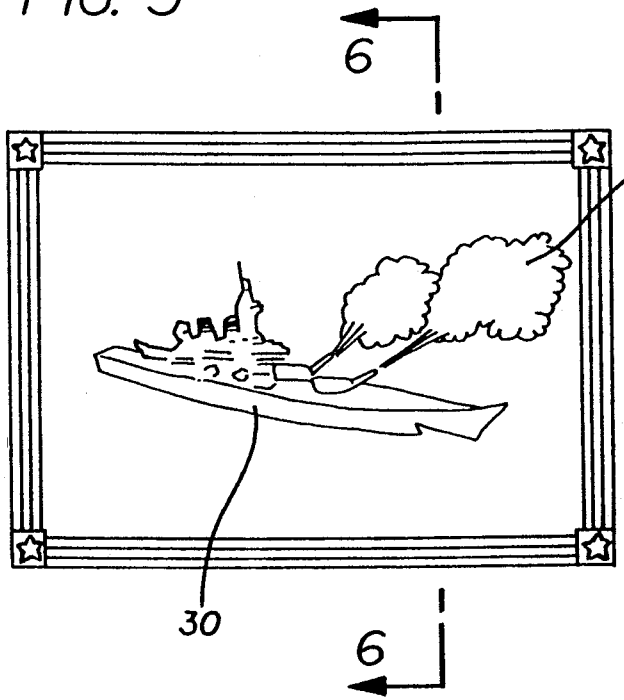
FIG. 5 is a view like FIG. 4, of the ship device, in a second state with both primary and secondary indicia being visible; and, FIG. 6. is a view in section taken on line 6—6 in FIG. 5.
Figure 4:
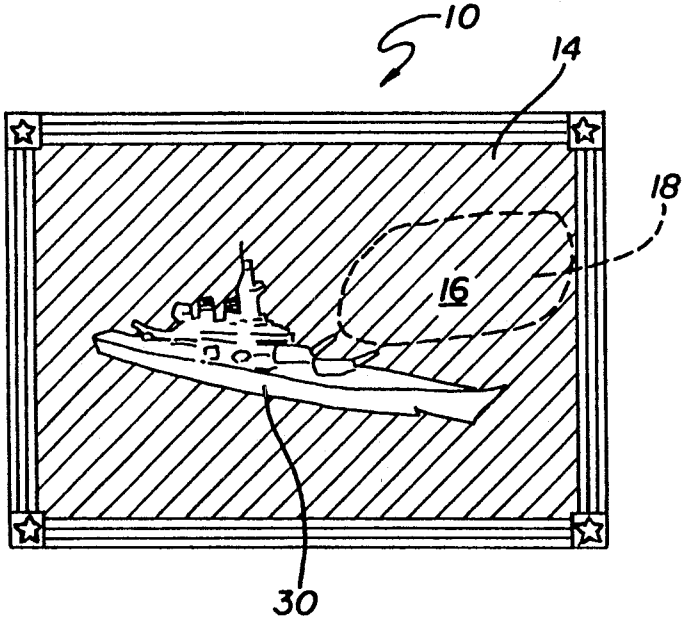
FIG. 4 is a view like FIG. 1, of a ship device in a first state with only primary indicia being visible.

In FIGS. 4–6, wherein like elements have like numbers, a ship 30 is shown in a first state as the primary indicium, and muzzle flash 32 from firing of the ship's guns, the ship in a second state, is shown as the secondary indicium. In this case, the muzzle flash 32 is printed with thermochromic ink transparent under ambient temperature conditions, and is thus invisible in FIG. 4. The ink becomes visible upon being heated above ambient temperature, providing the secondary indicium.

It will be noted in both instances that the primary and secondary indicia in both illustrative depictions of FIGS. 1–6 are subject matter related, and the resulting image therefore coherent in keeping with the present invention. The objects of the invention are thus met.

I claim:

1. Trading card having a variable printed image comprising subject-related primary and secondary indicia printed on the card surface, and means to make said secondary indicia non-visible at ambient temperatures to have said card display a first printed image and to make said secondary indicia visible at other than ambient temperatures to have said card display a second printed image, said means comprising on said trading card locally said secondary indicia comprised of a thermochromic composition in a state to make said secondary indicia non-visible, said thermochromic composition being responsive to an increased temperature therein from ambient sufficient for said secondary indicia to become visible, whereby effecting said temperature increase in said secondary indicia composition varies said card image.

2. The trading card according to claim 1, in which said change is said composition is reversible with reversion of temperature to ambient.

3. The trading card according to claim 1, in which said composition is temperature increasable from ambient by rubbing with the fingers.

4. The trading card according to claim 1, in which said card is made of cellulosic or plastic material.

5. The trading card according to claim 1, in which said coating comprises a plastic matrix with thermochromic inks distributed therein.

* * * * *